US009687029B2

(12) United States Patent
Liu

(10) Patent No.: US 9,687,029 B2
(45) Date of Patent: Jun. 27, 2017

(54) ELECTRONIC CIGARETTE WITH MULTIPLE ATOMIZER ASSEMBLIES

(71) Applicant: HUIZHOU KIMREE TECHNOLOGY CO., LTD, Huizhou, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen, Guangdong (CN)

( * ) Notice: Subject to any disclaimer, the term of this patent is extended or adjusted under 35 U.S.C. 154(b) by 121 days.

(21) Appl. No.: 14/739,332

(22) Filed: Jun. 15, 2015

(65) Prior Publication Data

US 2016/0015081 A1 Jan. 21, 2016

Related U.S. Application Data

(63) Continuation of application No. PCT/CN2014/082342, filed on Jul. 16, 2014.

(51) Int. Cl.
*A24F 47/00* (2006.01)
*H05B 3/16* (2006.01)

(52) U.S. Cl.
CPC ..... *A24F 47/008* (2013.01); *H05B 3/16* (2013.01); *H05B 2203/021* (2013.01)

(58) Field of Classification Search
CPC ..... A47F 47/008
See application file for complete search history.

(56) References Cited

U.S. PATENT DOCUMENTS 7,726,320 B2 * 6/2010 Robinson ..... A24F 47/008 131/194
9,301,547 B2 * 4/2016 Liu ..... A24F 47/008
(Continued)

FOREIGN PATENT DOCUMENTS

CN 202873798 U 4/2013
CN 203152480 U * 8/2013 ..... A24F 47/008
(Continued)

OTHER PUBLICATIONS

Liu Qiuming, CN 203152480 U, Aug. 2013, Translation of description.*

(Continued)

*Primary Examiner* — Jason L Lazorcik
*Assistant Examiner* — Taryn T Willett
(74) *Attorney, Agent, or Firm* — Yue Xu; U.S. Fairsky LLP

(57) ABSTRACT

An electronic cigarette with multiple atomizing assemblies is provided. The atomizing assembly includes a first atomizing device and a second atomizing device. When the cigarette liquid is atomized by the first atomizing device, the smoke generated by the first atomizing device generally contains large particles of the cigarette liquid that have been not sufficiently. The large particles of the cigarette liquid that have been not sufficiently atomized are delivered by the smoke towards the second atomizing device. When passing through the second atomizing device, the cigarette liquid that have been not sufficiently atomized is atomized again by the second atomizing device, thereby enabling the smoke to be more soft and smooth, subtly increasing the amount of the smoke, and preventing the user from sucking in large particles of the cigarette liquid that have been not sufficiently atomized.

14 Claims, 7 Drawing Sheets

(56) References Cited

U.S. PATENT DOCUMENTS 9,510,623 B2 * 12/2016 Tucker ..... H01C 17/00
2011/0303231 A1 * 12/2011 Li ..... A24F 47/008 131/329
2012/0285475 A1 * 11/2012 Liu ..... A24F 47/008 131/329
2013/0192615 A1 * 8/2013 Tucker ..... H01C 17/00 131/328
2013/0192618 A1 * 8/2013 Li ..... A24F 47/008 131/329
2013/0192623 A1 * 8/2013 Tucker ..... H01C 17/00 131/329
2013/0333711 A1 * 12/2013 Liu ..... A24F 47/008 131/329
2014/0182609 A1 * 7/2014 Liu ..... A24F 47/008 131/329
2014/0190503 A1 * 7/2014 Li ..... A61M 15/06 131/329
2014/0366898 A1 * 12/2014 Monsees ..... A24F 47/008 131/329
2015/0059787 A1 * 3/2015 Qiu ..... H05B 3/14 131/329
2015/0164146 A1 * 6/2015 Li ..... A24F 47/008 131/329
2015/0208728 A1 * 7/2015 Lord ..... A24F 7/00 131/329
2016/0015082 A1 * 1/2016 Liu ..... A24F 47/008 131/329
2016/0192707 A1 * 7/2016 Li ..... H05B 3/00 131/329
2016/0192710 A1 * 7/2016 Liu ..... H05B 3/40 131/329

FOREIGN PATENT DOCUMENTS

CN 103462224 A * 12/2013 ..... A24F 47/008
CN 103584286 A * 2/2014 ..... A24F 47/008
CN 103932403 A * 7/2014 ..... A24F 47/008
CN 203776159 U 8/2014
CN WO 2015143648 A1 * 10/2015 ..... A24F 47/008
WO 2013185357 A1 12/2013

OTHER PUBLICATIONS

Zhu Xiaochun, WO 2015143648 A1, Oct. 2015, Translation of description.*
Qiu Weihua, CN 103462224 A, Dec. 2013, Translation of description.*
Zhu Xiaochun, CN 103932403 A, Jul. 2014, Translation of description.*
Luo Hongyong, CN 103584286 A, Feb. 2014, Translation of description.*
International Search Report corresponding to Application No. PCT/CN2014/082342; Date of Mailing: Mar. 27, 2015.

* cited by examiner

ELECTRONIC CIGARETTE WITH MULTIPLE ATOMIZER ASSEMBLIES

CROSS REFERENCE TO RELATED APPLICATIONS

This application is a continuation under 35 U.S.C. §120 of International Application No. PCT/CN2014/082342, filed on Jul. 16, 2014, the entire disclosure of which is incorporated herein by reference.

TECHNICAL FIELD

The present application relates to the technical field of electronic cigarettes, and particularly to an electronic cigarette with multiple atomizer assemblies.

BACKGROUND

The structure of a conventional electronic cigarette is shown in FIG. 1. As shown in FIG. 1, the conventional electronic cigarette includes an atomizer 110 and a battery rod 120 which are connected to each other. An atomizer assembly 112 is provided inside the atomizer 110. When a user smokes the electronic cigarette, the battery rod 120 provides power to the atomizer assembly 112, to allow the atomizer assembly 112 to atomize cigarette liquid to generate smoke.

The conventional atomizer 110 generally includes only one atomizer assembly 112, and the atomizer assembly 112 and the atomizer 110 are formed integrally and cannot be detached from each other. The entire atomizer 110 is required to be replaced when the atomizer assembly 112 is damaged. Further, the atomizer assembly 112 of the electronic cigarette has a high fault rate. If the atomizer assembly 112 is damaged, the electronic cigarette cannot operate normally, then the user has to replace the atomizer 110 or the entire electronic cigarette, which not only increases the cost of the electronic cigarette, but also leads to waste, and brings a huge inconvenience to the user.

SUMMARY

In view of the above technical problems, an electronic cigarette with a plurality of atomizer assemblies is provided according to the present application. The electronic cigarette includes an atomizer and a battery rod connected to each other, wherein the atomizer includes a suction nozzle assembly, an atomizing core, and a connecting sleeve;

the suction nozzle assembly is provided with a liquid storage sleeve, an air pipe arranged in the liquid storage sleeve in an axial direction of the liquid storage sleeve, and a suction nozzle arranged at an end of the liquid storage sleeve; a liquid storage chamber for storing cigarette liquid is defined by the liquid storage sleeve, and an air channel allowing airflow to flow to the suction nozzle is defined by the air pipe;

two ends of the connecting sleeve are configured to be detachably connected to the suction nozzle assembly and the battery rod, respectively;

two ends of the atomizing core are configured to be detachably connected to the connecting sleeve and the air pipe, respectively; the atomizing core and the air pipe are elastically abutted against each other or are insertedly connected, to fix the atomizing core between the suction nozzle assembly and the connecting sleeve; and the atomizing core is arranged in the liquid storage chamber and is hermetically connected to the air pipe;

the atomizing core is provided with an atomizing sleeve, a cigarette liquid locking part made of liquid-absorbing material, an atomizing seat, and an atomizing assembly;

the atomizing sleeve is provided for wrapping and protecting elements inside the atomizing core, and the atomizing sleeve is provided with a liquid guiding hole which is in communication with the liquid storage chamber;

the cigarette liquid locking part is inserted in the atomizing sleeve and covers an outer circumferential surface of the atomizing seat, and the cigarette liquid locking part fits closely with an inner circumferential surface of the atomizing sleeve, and is configured to deliver, via the liquid guiding hole on the atomizing sleeve, the cigarette liquid in the liquid storage chamber to the atomizing assembly to be atomized;

the atomizing seat is provided with an atomizing chamber, and the atomizing chamber is in communication with the air channel, and is configured to accommodate the atomizing assembly and deliver smoke, which is atomized by the atomizing assembly, to the air channel;

the atomizing assembly includes a first atomizing device and a second atomizing device which are arranged in a radial direction of the electronic cigarette and abut against the cigarette liquid locking part;

the first atomizing device includes at least two heat generating devices for atomizing the cigarette liquid, the heat generating devices of the first atomizing device are arranged in parallel, a liquid guiding part made of a liquid-absorbing material is provided between the heat generating devices and is arranged in parallel with the heat generating devices and abuts against the heat generating devices, two ends of the liquid guiding part both abut against the cigarette liquid locking part; and the second atomizing device includes at least one heat generating device; and the first atomizing device and the second atomizing device are crossed with each other, and the second atomizing device is arranged close to the suction nozzle, and is spaced from the first atomizing device by a certain space interval.

Preferably, each of the heat generating devices is provided with a heater for atomizing the cigarette liquid, and a liquid guiding wick which is configured to be winded and fixed by the heater and to deliver the cigarette liquid to the heater to be atomized Preferably, the liquid guiding part is a glass fiber rope.

Preferably, an accommodating groove with one end open and configured to fix the atomizing assembly is provided at a wall of the atomizing chamber of the atomizing seat;

the accommodating groove includes a first accommodating groove, a second accommodating groove, a third accommodating groove, and a fourth accommodating groove;

the first accommodating groove and the second accommodating groove are arranged opposite to each other, have the same groove depth, and are jointly configured to accommodate the first atomizing device; and the third accommodating groove and the fourth accommodating groove are arranged opposite to each other, have the same groove depth, and are jointly configured to accommodate the second atomizing device; and the groove depth of each of the first accommodating groove and the second accommodating groove is greater than the groove depth of each of the third accommodating groove and the fourth accommodating groove.

Preferably, the air pipe is inserted into the atomizing sleeve, and is hermetically connected to the atomizing sleeve, a snap ring is provided at one end of the atomizing sleeve; and a sealing gasket is sleeved on the air pipe and hermetically abuts against the snap ring.

Preferably, a connection portion of the atomizing sleeve and the air pipe is provided with an accommodating groove for accommodating the sealing gasket; and an end of the air pipe hermetically abuts against the accommodating groove in which the sealing gasket is accommodated, to form a sealing connection with the atomizing sleeve.

Preferably, a battery assembly for powering the atomizing assembly is arranged in the battery rod;

an inner electrode and an outer electrode which are electrically connected to the atomizing assembly are further provided at an end of the atomizing core away from the air pipe;

the inner electrode and the outer electrode are configured to be electrically connected to the battery assembly, to allow the battery assembly to power the atomizing assembly;

a snap ring is provided at one end of the atomizing sleeve;

a retaining collar is provided on the outer electrode; and the snap ring and the retaining collar are configured to fix the atomizing seat between the snap ring and the retaining collar.

Preferably, the connecting sleeve is provided with internal threads; and the outer electrode is provided with external threads configured to cooperate with the internal threads of the connecting sleeve, and a threaded connection portion of the outer electrode and the connecting sleeve is provided with a first sealing ring, and the first sealing ring is configured to seal the threaded connection portion of the outer electrode and the connecting sleeve, to prevent the cigarette liquid in the liquid storage chamber from flowing into the battery rod.

Preferably, the connecting sleeve is threadedly connected to the suction nozzle assembly; and a sealing groove is provided at a threaded connection portion of the connecting sleeve and the suction nozzle assembly, and a second sealing ring is accommodated in the sealing groove, and is configured to seal the threaded connection portion of the connecting sleeve and the suction nozzle assembly, to prevent the cigarette liquid in the liquid storage chamber from flowing out of the suction nozzle assembly; and at least two sealing grooves are provided, and at least two second sealing rings are provided.

Preferably, the cigarette liquid locking part is non-woven cloth or liquid storage cotton.

Preferably, the heater is an electric heating wire; and the electric heating wire is made of nickel-chromium alloy.

Preferably, the electronic cigarette further includes a decorating part made of metal;

the decorating part is configured to be detachably connected to the connecting sleeve, and the decorating part wraps a connection portion of the connecting sleeve and the suction nozzle assembly; and a concave portion is provided on the liquid storage sleeve at a position close to the connection portion of the connecting sleeve and the suction nozzle assembly, a thickness of the liquid storage sleeve at the concave portion is smaller than a wall thickness of the liquid storage sleeve, and in the case that the decorating part wraps the connection portion of the connecting sleeve and the suction nozzle assembly, the decorating part is accommodated in the concave portion, to allow the electronic cigarette have a smooth appearance.

Preferably, the first atomizing device is perpendicular to the second atomizing device.

Preferably, the liquid storage sleeve is transparent.

Based on the above technical solutions, the present application has the following advantages.

The suction nozzle assembly may not only allow the user to smoke, but also store the cigarette liquid inside the liquid storage chamber, thereby reducing the length of the electronic cigarette, and facilitate carrying the electronic cigarette. The suction nozzle assembly may be detachably connected to the connecting sleeve, and the atomizing core is fixed between the suction nozzle assembly and the connecting sleeve. When the cigarette liquid in the liquid storage chamber of the suction nozzle assembly is used up, the connecting sleeve may be removed and the cigarette liquid can be filled into the liquid storage chamber, which can increase the service life of the electronic cigarette. Further, if the atomizing core is damaged, the atomizing core may be removed to facilitate replacement. Multiple heat generating devices are arranged in the atomizing core to atomize the cigarette liquid. Thus, in the case that one or several of the heat generating devices are damaged, the electronic cigarette can continue to work as long as one of the heat generating devices is not damaged, thereby reducing the damage rate of the atomizing assembly. Further, the multiple heat generating devices operating at the same time may generate more smoke, thus the user can have better experience. In the present application, the atomizing assembly is provided with the first atomizing device and the second atomizing device. When the cigarette liquid is atomized by the first atomizing device, the generated smoke generally contains large particles of the cigarette liquid that have been not sufficiently. The large particles of the cigarette liquid that have been not sufficiently atomized are delivered by the smoke towards the second atomizing device. When passing through the second atomizing device, the cigarette liquid that have been not sufficiently atomized is atomized again by the second atomizing device, thereby enabling the smoke to be more soft and smooth, subtly increasing the amount of the smoke, and preventing the user from sucking in large particles of the cigarette liquid that have been not sufficiently atomized. Two groups of crossed atomizing devices are provided and are spaced from each other by a certain interval, which makes the particles of the smoke more soft and smooth, allows the user to have a better mouth feel when smoking the electronic cigarette, and improves the user experience. In addition, since the liquid guiding part made of the liquid-absorbing material and arranged between the heat generating devices is arranged in parallel with the heat generating devices and abuts against the heat generating devices, thus the cigarette liquid can be delivered to the middle area of the heat generating devices via the liquid guiding part, to avoid the situation that the cigarette liquid in the heat generating devices cannot be delivered to its middle area and further causes dry-heating of the middle area. Further, the adjacent heat generating devices are isolated by the liquid guiding part, to avoid coming into contact with each other which may cause conditions such as a short circuit or an unstable power output.

BRIEF DESCRIPTION OF THE DRAWINGS

For more clearly illustrating embodiments of the present application or the technical solution in the conventional technology, drawings referred to describe the embodiments or the conventional technology will be briefly described hereinafter. Apparently, the drawings in the following description are only several embodiments of the present application, and for the person skilled in the art other drawings may be obtained based on these drawings without any creative efforts.

REFERENCE NUMERALS

| | | | |
|---|---|---|---|
| 11 | suction nozzle assembly; | 12 | atomizing core; |
| 13 | connecting sleeve; | 21 | suction nozzle; |
| 22 | air channel; | 23 | liquid storage chamber; |
| 24 | air pipe; | 25 | snap ring; |
| 26 | retaining collar; | 27 | liquid storage sleeve; |
| 31 | first atomizing device; | 32 | second atomizing device; |
| 33 | atomizing sleeve; | 34 | cigarette liquid locking part; |
| 35 | liquid guiding part; | 36 | liquid guiding hole; |
| 37 | atomizing seat; | 38 | sealing ring; |
| 39 | heat generating device; | 41 | outer electrode; |
| 42 | inner electrode; | 43 | insulating ring; |
| 51 | liquid guiding wick; | 52 | heating wire; |
| 61 | first accommodating groove; | 62 | second accommodating groove; |
| 63 | third accommodating groove; | 64 | fourth accommodating groove; |
| 71 | first sealing ring; | 72 | second sealing ring; |
| 73 | decorating part; and | 74 | concave portion. |

DETAILED DESCRIPTION

In order to make the purposes, features, and advantage of the present application more apparent and easy to understand, the technical solutions in the embodiments of the present application will be described clearly and completely hereinafter in conjunction with the drawings in the embodiments of the present application. Apparently, the described embodiments are only a part of the embodiments of the present application, rather than all embodiments. Based on the embodiments in the present application, all of other embodiments, made by the person skilled in the art without any creative efforts, fall into the scope of the present application.

Figure 1:
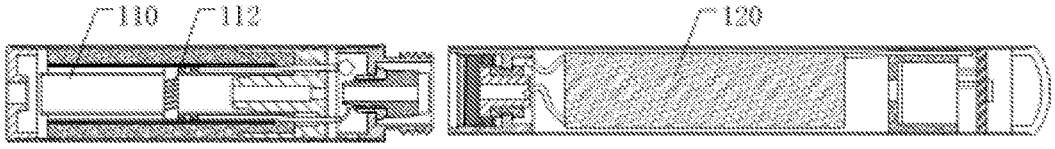
Figure 1 Prior Art
FIG. 1 is a sectional view showing the overall structure of a conventional electronic cigarette.
Figure 2:
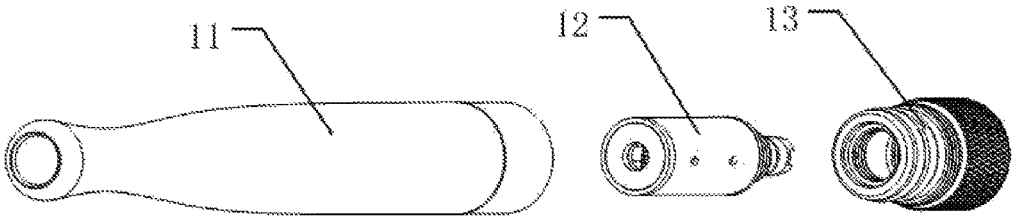
FIG. 2 is a structural view of an atomizer of the electronic cigarette according to the present application.
Figure 3:
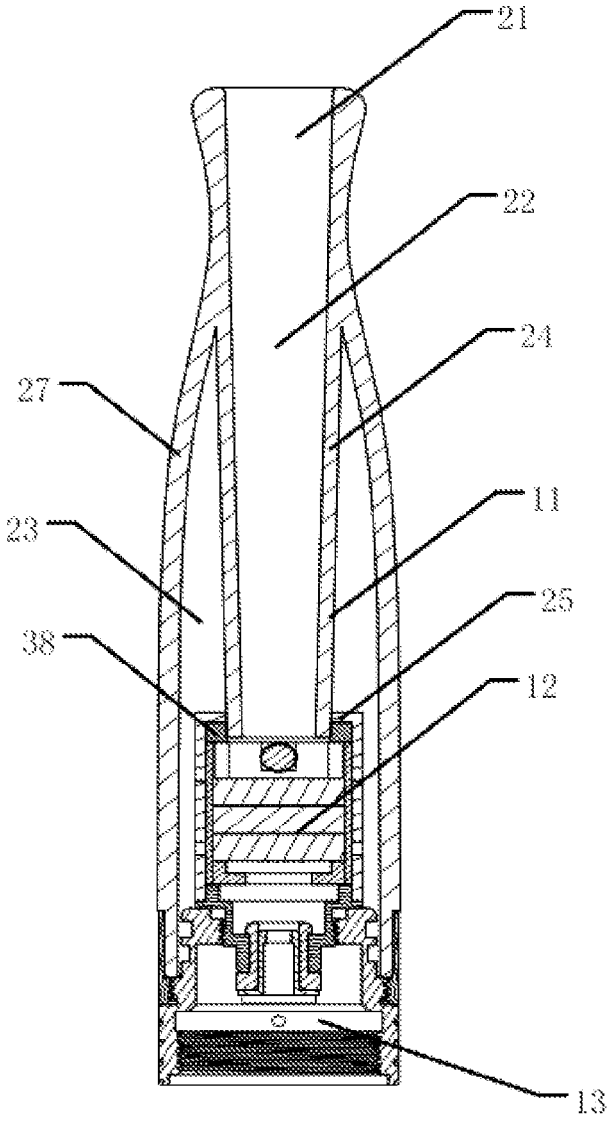
FIG. 3 is a sectional view showing the structure of an embodiment of an atomizer of the electronic cigarette according to the present application.
Figure 4:
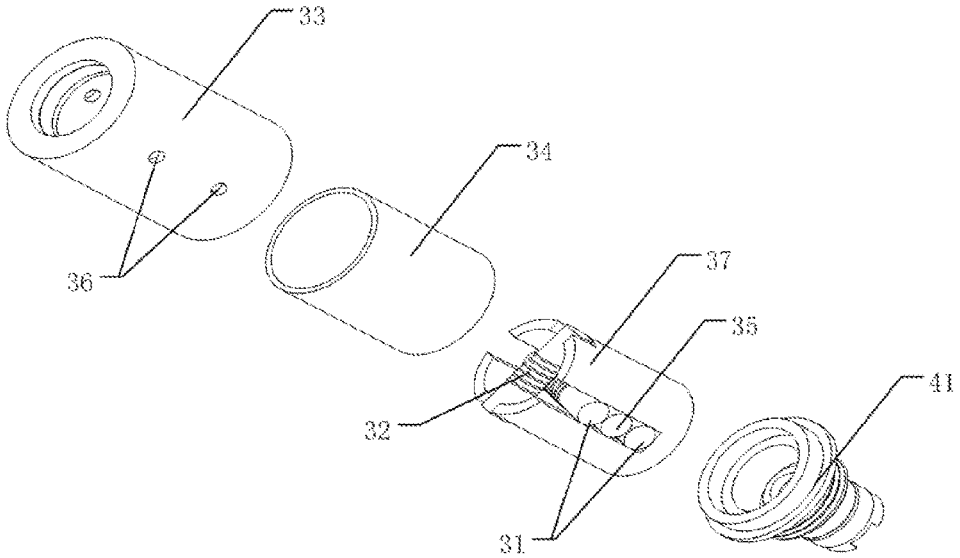
FIG. 4 is a structural view of an atomizing core of the electronic cigarette according to an embodiment of the present application.
Figure 9:
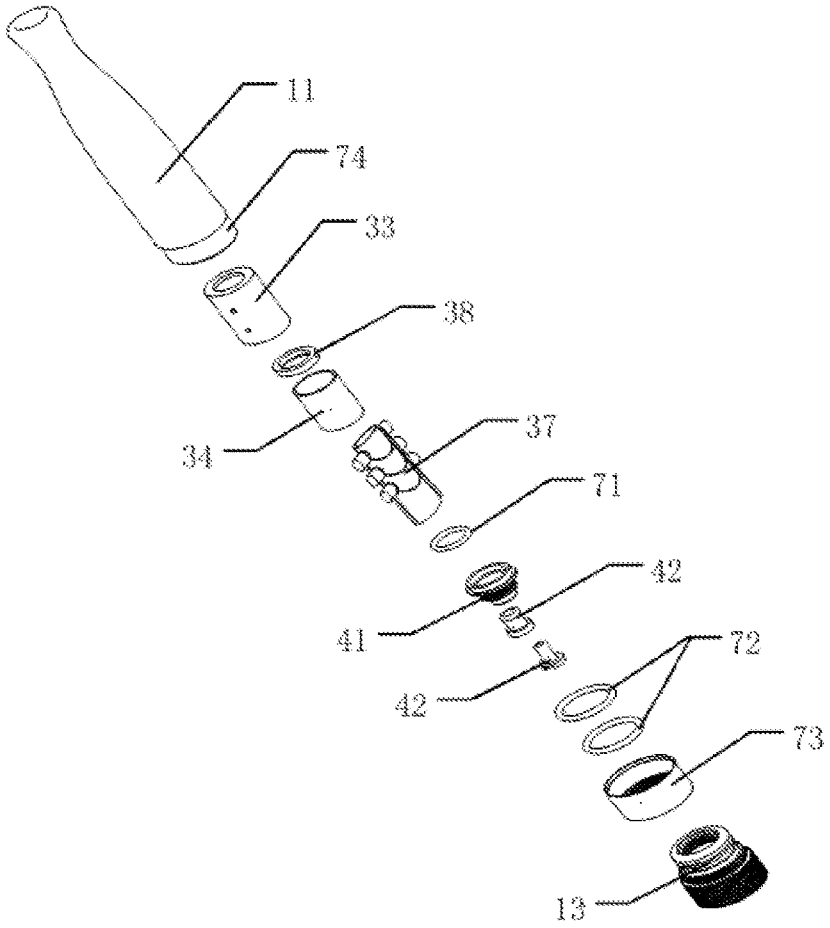
FIG. 9 is an exploded view of the electronic cigarette according to the present application.

A first embodiment is shown in FIG. 2 in conjunction with FIG. 3, FIG. 4, and FIG. 9.

An electronic cigarette with multiple atomizing assemblies is provided according to the present application. The electronic cigarette includes an atomizer and a battery rod (not shown) which are connected to each other. The atomizer includes a suction nozzle assembly 11, an atomizing core 12, and a connecting sleeve 13.

The suction nozzle assembly 11 is provided with a liquid storage sleeve 27, an air pipe 24 arranged in the liquid storage sleeve 27 in an axial direction of the liquid storage sleeve 27, and a suction nozzle 21 arranged at an end of the liquid storage sleeve 27. A liquid storage chamber 23 for storing cigarette liquid is defined by the liquid storage sleeve 27. An air channel 22 allowing airflow to flow to the suction nozzle is defined by the air pipe 24.

Two ends of the connecting sleeve 13 may be detachably connected to the suction nozzle assembly 11 and the battery rod, respectively.

Two ends of the atomizing core 12 may be detachably connected to the connecting sleeve 13 and the air pipe 24, respectively. The atomizing core 12 and the air pipe 24 are elastically abutted against each other or are insertedly connected, thus, the atomizing core 12 is fixed between the suction nozzle assembly 11 and the connecting sleeve 13, and the atomizing core 12 is arranged in the liquid storage chamber 23, and is hermetically connected to the air pipe 24.

The atomizing core 12 is provided with an atomizing sleeve 33, a cigarette liquid locking part 34 made of liquid-absorbing material, an atomizing seat 37, and an atomizing assembly.

The atomizing sleeve 33 is provided for wrapping and protecting elements inside the atomizing core 12, and the atomizing sleeve 33 is provided with a liquid guiding hole 36 which is in communication with the liquid storage chamber 23.

The cigarette liquid locking part 34 is inserted in the atomizing sleeve 33 and covers an outer circumferential surface of the atomizing seat 37. The cigarette liquid locking part 34 fits closely with an inner circumferential surface of the atomizing sleeve 33, and is used to deliver, via the liquid guiding hole 36 on the atomizing sleeve 33, the cigarette liquid in the liquid storage chamber 23 to the atomizing assembly to be atomized.

The atomizing seat 37 is provided with an atomizing chamber. The atomizing chamber is in communication with the air channel 22, and is configured to accommodate the atomizing assembly and deliver smoke, which is atomized by the atomizing assembly, to the air channel.

The atomizing assembly includes a first atomizing device 31 and a second atomizing device 32 which are arranged in a radial direction of the electronic cigarette and abut against the cigarette liquid locking part 34.

The first atomizing device 31 includes at least two heat generating devices 39 for atomizing the cigarette liquid. The heat generating devices 39 of the first atomizing device 31 are arranged in parallel. A liquid guiding part 35 made of a liquid-absorbing material is provided between the heat generating devices 39 and is arranged in parallel with the heat generating devices 39 and abuts against the heat generating devices 39. Two ends of the liquid guiding part 35 both abut against the cigarette liquid locking part 34. The second atomizing device 32 includes at least one heat generating device 39.

The first atomizing device 31 and the second atomizing device 32 are crossed with each other. The second atomizing device 32 is arranged close to the suction nozzle 21, and is spaced from the second atomizing device 32 by a certain space interval.

Thus, the suction nozzle assembly 11 may not only allow the user to smoke, but also store the cigarette liquid inside the liquid storage chamber 23, thereby reducing the length of the electronic cigarette, and facilitate carrying the electronic cigarette. The suction nozzle assembly 11 may be detachably connected to the connecting sleeve 13, and the atomizing core 12 is fixed between the suction nozzle assembly 11 and the connecting sleeve 13. When the cigarette liquid in the liquid storage chamber 23 of the suction nozzle assembly 11 is used up, the connecting sleeve 13 may be removed and the cigarette liquid can be filled into the liquid storage chamber 23, which can increase the service life of the electronic cigarette. Further, if the atomizing core 12 is damaged, the atomizing core 12 may be removed to facilitate replacement. Multiple heat generating devices 39 are arranged in the atomizing core 12 to atomize the cigarette liquid. Thus, in the case that one or several of the heat generating devices 39 are damaged, the electronic cigarette can continue to work as long as one of the heat generating devices 39 is not damaged, thereby reducing the damage rate of the atomizing assembly. Further, the multiple heat generating devices 39 operating at the same time may generate more smoke, thus the user can have better experience. In the present application, the atomizing assembly is provided with the first atomizing device 31 and the second atomizing device 32. If the user does not smoke the electronic cigarette in a long time, the cigarette liquid stored in the heat generating devices 39 is in a supersaturated state, and in this case, when the cigarette liquid is atomized by the first atomizing device 31, a small amount of smoke is generated, and the smoke contains large particles of the cigarette liquid that have been not sufficiently. The large particles of the cigarette liquid that have been not sufficiently atomized are delivered by the smoke towards the second atomizing device 32. When passing through the second atomizing device 32, the cigarette liquid that have been not sufficiently atomized is atomized again by the second atomizing device 32, thereby enabling the smoke to be more soft and smooth, subtly increasing the amount of the smoke, and preventing the user from sucking in large particles of the cigarette liquid that have been not sufficiently atomized Two groups of crossed atomizing devices are provided and are spaced from each other by a certain interval, which makes the particles of the smoke more soft and smooth, allows the user to have a better mouth feel when smoking the electronic cigarette, and improves the user experience. In addition, since the liquid guiding part 35 made of the liquid-absorbing material and arranged between the heat generating devices 39 is arranged in parallel with the heat generating devices 39 and abuts against the heat generating devices 39, thus the cigarette liquid can be delivered to the middle area of the heat generating devices 39 via the liquid guiding part 35, to avoid the situation that the cigarette liquid in the heat generating devices 39 cannot be delivered to its middle area and further causes dry-heating of the middle area. Further, the adjacent heat generating devices 39 are isolated by the liquid guiding part 35, to avoid coming into contact with each other which may cause conditions such as a short circuit or an unstable power output.

In this embodiment, the first atomizing device 31 includes at least two heat generating devices 39 for atomizing the cigarette liquid. Generally, the number of the heat generating devices 39 of the first atomizing device 31 may be two, three, or four, and etc. The second atomizing device 32 includes at least one heat generating device 39. The number of the heat generating device 39 of the second atomizing device 32 may be one or two and etc. The first atomizing device 31 is a main atomizing device, and has more heat generating devices 39 than the second atomizing device 32, to generate more smoke. However, the number of the heat generating devices 39 of the first atomizing device 31 cannot be too large, otherwise excessive heat generating devices 39 may increase the heating amount, and when the electronic cigarette is operated for a long time, the electronic cigarette is prone to operate unstably, besides, the production cost would also be increased. Certainly, the above condition is also applicable for the second atomizing device 32. Preferably, the first atomizing device 31 includes two heat generating devices 39, and the second atomizing device 32 includes one heat generating device 39. The heat generating devices 39 of the first atomizing device 31 are arranged in parallel, and in the case that the second atomizing device 32 includes multiple heating generating devices 39, the heating generating devices 39 thereof are also arranged in parallel.

Figure 6:
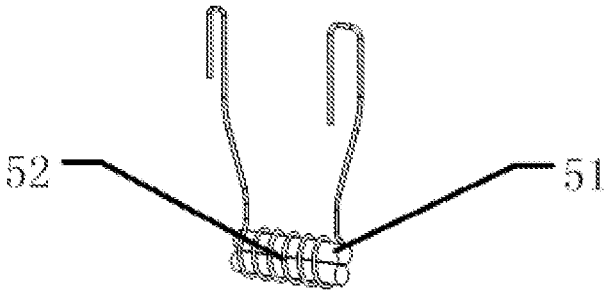
FIG. 6 is a structural view of a heat generating device of the electronic cigarette according to the embodiment of the present application.

In this embodiment, referring to FIG. 6, each of the heat generating devices 39 is provided with a heating wire 52 for atomizing the cigarette liquid, and a liquid guiding wick 51 which is winded and fixed by the heating wire 52 and is configured to deliver the cigarette liquid to the heating wire to be atomized That is, the heating wire 52 acts as a heater for atomizing the cigarette liquid, and the liquid guiding wick 51 is mainly used for storing the cigarette liquid to be heated by the heating wire 52 to generate the smoke.

In this embodiment, the liquid guiding wick 51 may be made of liquid storage cotton or a glass fiber rope that can store the cigarette liquid. In this embodiment, the glass fiber rope is employed, since the glass fiber rope has resistance to high temperature and corrosion, and excellent insulation performance and inflaming retarding performance, and can be winded and fixed well by the heating wire 52. In this embodiment, multi-strand glass fiber ropes may be winded by the heating wire 52, thus a large amount of liquid can be stored, however, the number of the glass fiber ropes cannot be too large; otherwise, the excessive cigarette liquid may cause a poor atomizing performance. Preferably, two-strand or three-strand glass fiber ropes may be employed.

In this embodiment, the heating wire 52 is embodied as an electric heating wire. The electric heating wire may be made of nickel-chromium alloy. The diameter of the electric heating wire ranges from 0.08 mm to 0.12 mm.

In this embodiment, the suction nozzle assembly is threadedly connected to the connecting sleeve. Certainly, the suction nozzle assembly and the connecting sleeve can also be connected by snap fit or a magnet connection.

In this embodiment, the cigarette liquid locking part 34 may employ non-woven cloth or liquid storage cotton to wrap the atomizing assembly, to guide the cigarette liquid and prevent the liquid guiding wick 51 of the atomizing assembly from being exposed, thus, the atomizing core 12 will have an integral appearance.

Figure 5:
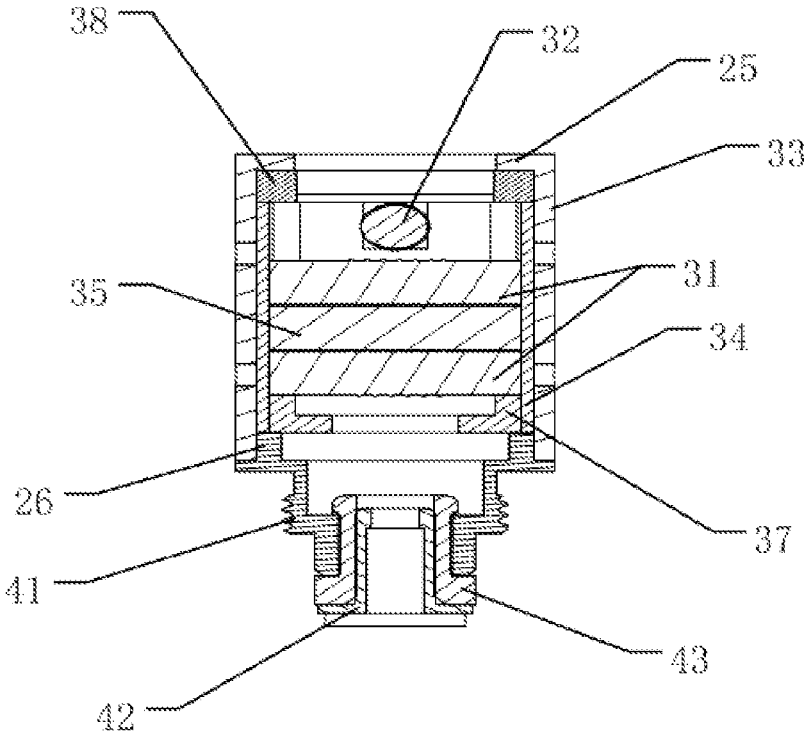
FIG. 5 is a sectional view of the atomizing core of the electronic cigarette according to the embodiment of the present application.

In this embodiment, referring to FIG. 5, the liquid guiding part 35 is arranged between the heat generating devices 39 of the first atomizing device 31. The opposite two ends of the liquid guiding part 35 abut against the heat generating devices 39 adjacent to the liquid guiding part 35, respectively. The liquid guiding part 35 is provided for insulating the heat generating devices 39 from each other, to prevent a short circuit of the heat generating devices 39, and the liquid guiding part 35 may also guide the cigarette liquid to be atomized by the heat generating devices 39, which may better avoid the dry-heating at the middle area of the heat generating devices 39 due to the shortage of the cigarette liquid.

In the present application, the liquid guiding part 35 employs a glass fiber rope, since the glass fiber rope has resistance to high temperature and corrosion, and excellent insulation performance and inflaming retarding performance.

Figure 7:
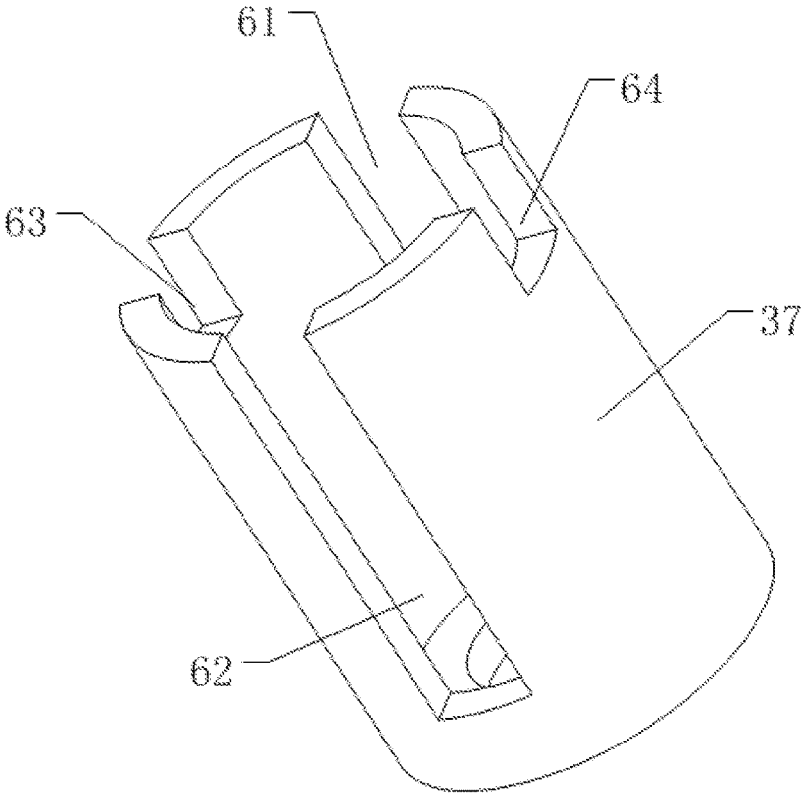
FIG. 7 is a structural view of an atomizing seat of the electronic cigarette according to the embodiment of the present application.

In this embodiment, an accommodating groove with one end open and configured to fix the atomizing assembly is provided at the wall of the atomizing chamber of the atomizing seat 37. Reference is made to FIG. 5 in conjunction of FIG. 7.

The accommodating groove includes a first accommodating groove 61, a second accommodating groove 62, a third accommodating groove 63, and a fourth accommodating groove 64.

The first accommodating groove 61 and the second accommodating groove 62 are arranged opposite to each other, have the same groove depth, and are jointly used for accommodating the first atomizing device 31.

The third accommodating groove 63 and the fourth accommodating groove 64 are arranged opposite to each other, have the same groove depth, and are jointly used for accommodating the second atomizing device 32. The groove depth of each of the first accommodating groove 61 and the second accommodating groove 62 is greater than the groove depth of each of the third accommodating groove 63 and the fourth accommodating groove 64.

It will be appreciated that, the first atomizing device 31 is accommodated in the first accommodating groove 61 and the second accommodating groove 62, thus the first atomizing device 31 is fixed. The second atomizing device 32 is accommodated in the third accommodating groove 63 and the fourth accommodating groove 64, thus the second atomizing device 32 is fixed. The groove depth of each of the first accommodating groove 61 and the second accommodating groove 62 is greater than the groove depth of the third accommodating groove 63 and the fourth accommodating groove 64, thus the first atomizing device 31 is arranged at an end of atomizing seat 37 away from the suction nozzle, and the second atomizing device 32 is closer to the suction nozzle than the first atomizing device 31.

The straight line formed between the first accommodating groove 61 and the second accommodating groove 62 intersects the straight line formed between the third accommodating groove 63 and the fourth accommodating groove 64, thus the first atomizing device 31 and the second atomizing device 32 are also crossed with each other.

In this embodiment, the suction nozzle assembly 11 is further provided with an air pipe 24 for isolating the air channel 22 from the liquid storage chamber 23. The connection portion of the atomizing sleeve 33 and the air pipe 24 is provided with a sealing gasket 38 made of elastic material. The sealing gasket 38 is provided for preventing the cigarette liquid in the liquid storage chamber 23 from flowing into the air channel 24 through the connection portion of the atomizing sleeve 33 and the air pipe 24. The sealing gasket 38 may be made of rubber, silica gel, or foam, and etc. The specific material of the sealing gasket 38 is not limited here.

It will be appreciated that, after the atomizing core 12 is inserted into the suction nozzle assembly, the cigarette liquid in the liquid storage chamber 23 may flow into the air channel 22 if the connection portion of the atomizing sleeve 33 and the air pipe 24 is not sealed, which further affects the normal smoking of the user. Thus, the sealing gasket 38 provided between the atomizing sleeve 33 and the air pipe 24 can effectively prevent the inflow of the cigarette liquid.

In this embodiment, the air pipe 24 is inserted into the atomizing sleeve 33, and is hermetically connected to the atomizing sleeve 33. A snap ring 25 is provided at one end of the atomizing sleeve 33. The sealing gasket 38 is sleeved on the air pipe 24 and hermetically abuts against the snap ring 25.

In this embodiment, a battery assembly for powering the atomizing assembly is provided inside the battery rod. The battery rod has the conventional structure, which will not be described here.

The atomizing core 12 is further provided with an outer electrode 41 and an inner electrode 42.

The outer electrode 41 and the inner electrode 42 are provided for to be electrically connected to the battery assembly, to allow the battery assembly to power the atomizing assembly. In this embodiment, the outer electrode 41 is electrically connected to the connecting sleeve 13, to be electrically connected to the battery assembly via the connecting sleeve 13. The snap ring 25 is provided at one end of the atomizing sleeve. A retaining collar 26 is provided on the outer electrode.

The snap ring 25 and the retaining collar 26 are used for fixing the atomizing seat 37 between the snap ring 25 and the retaining collar 26.

In this embodiment, an insulating ring 43 is provided between the outer electrode 41 and the inner electrode 42 to isolate the outer electrode 41 from the inner electrode 42, to prevent a short circuit.

In this embodiment, the connecting sleeve 13 is provided with internal threads.

The outer electrode 41 is provided with external threads which cooperate with the internal threads of the connecting sleeve 13. A threaded connection portion of the outer electrode 41 and the connecting sleeve 13 is provided with a first sealing ring 71. The first sealing ring 71 is provided for sealing the threaded connection portion of the outer electrode 41 and the connecting sleeve 13, to prevent the cigarette liquid in the liquid storage chamber 23 from flowing into the battery rod.

In this embodiment, the connecting sleeve 13 is threadedly connected to the suction nozzle assembly 11.

A sealing groove is provided at a threaded connection portion of the connecting sleeve 13 and the suction nozzle assembly 11. A second sealing ring 72 is accommodated in the sealing groove, and is provided for sealing the threaded connection portion of the connecting sleeve and the suction nozzle assembly 11, to prevent the cigarette liquid in the liquid storage chamber 23 from flowing out of the suction nozzle assembly 11.

At least two sealing grooves are provided, and at least two second sealing rings 72 are provided. It will be appreciated that, the at least two sealing grooves and the at least two second sealing rings 72 can better prevent the cigarette liquid in the liquid storage chamber 23 from flowing out of the suction nozzle assembly 11. For example, if one of the second sealing rings 72 is disabled, other second sealing ring 72 may also prevent the cigarette liquid from flowing out.

In this embodiment, the electronic cigarette further includes a decorating part 73 made of metal. The decorating part 73 may be detachably connected to the connecting sleeve 13, and the decorating part 73 wraps the connection portion of the connecting sleeve 13 and the suction nozzle assembly 11.

A concave portion 74 is provided on the liquid storage sleeve 27 at a position close to the connection portion of the connecting sleeve 13 and the suction nozzle assembly 11. The thickness of the liquid storage sleeve 27 at the concave portion is smaller than the wall thickness of the liquid storage sleeve 27. When the decorating part 73 wraps the connection portion of the connecting sleeve 13 and the suction nozzle assembly 11, the decorating part 73 is accommodated in the concave portion 74, thus, the appearance of the electronic cigarette is smooth and aesthetic. In this embodiment, the liquid storage sleeve 27 is a transparent body made of plastic cement, which facilitates observing the remaining amount of the cigarette liquid in the liquid storage sleeve 27 to fill the cigarette liquid in time when the cigarette liquid is used up. The decorating part 73 is made of metal, thus the reliability of the connection between the decorating part 73 and the connecting sleeve 13 is improved, which also prolongs the service life of the electronic cigarette.

Figure 8:
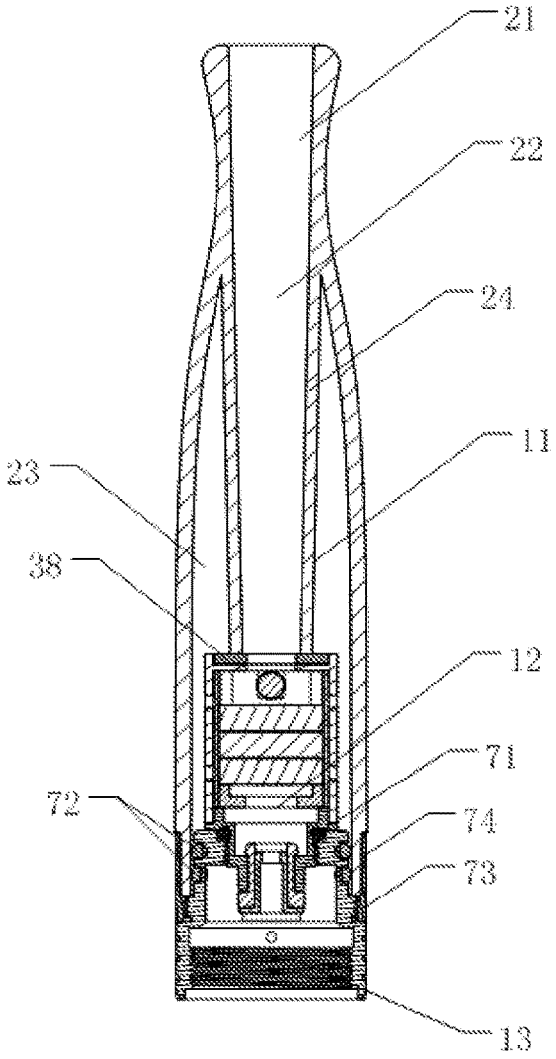
FIG. 8 is a sectional view showing the structure of the electronic cigarette according to another embodiment of the present application.

A second embodiment is provided, which is shown in FIG. 8.

Unlike the first embodiment, in this embodiment, an accommodating groove for accommodating the sealing gasket 38 is provided at the connection portion of the atomizing sleeve 33 and the air pipe 24. The end of the air pipe 24 hermetically abuts against the accommodating groove with the sealing gasket 38 therein, thereby forming a sealing connection with the atomizing sleeve 33. This manner has advantages of being easy to assemble and easy to use.

A third embodiment is provided.

Unlike the first embodiment and the second embodiment, in this embodiment, the first atomizing device 31 is perpendicular to the second atomizing device 32.

In this embodiment, the first accommodating groove 61, the second accommodating groove 62, the third accommodating groove 63, and the fourth accommodating groove 64 are distributed uniformly on the atomizing seat 37, and the first accommodating groove 61 is opposite to the second accommodating groove 62, and the third accommodating groove 63 is opposite to the fourth accommodating groove 64. Thus, it is ensured that the first atomizing device 31 is perpendicular to the second atomizing device 32. The perpendicular arrangement between the first atomizing device 31 and the second atomizing device 32 may heat the airflow passing through the atomizing chamber more uniformly.

The above embodiments are described in a progressive manner. Each of the embodiments is mainly focused on describing its differences from other embodiments, and references may be made among these embodiments with respect to the same or similar portions among these embodiments.

Based on the above description of the disclosed embodiments, the person skilled in the art is capable of carrying out or using the present application. It is obvious for the person skilled in the art to make many modifications to these embodiments. The general principle defined herein may be applied to other embodiments without departing from the spirit or scope of the present application. Therefore, the present application is not limited to the embodiments illustrated herein, but should be defined by the broadest scope consistent with the principle and novel features disclosed herein.

The invention claimed is:

1. An electronic cigarette with a plurality of atomizing assemblies, comprising an atomizer and a battery rod connected to each other, wherein the atomizer comprises a suction nozzle assembly, an atomizing core, and a connecting sleeve;

the suction nozzle assembly is provided with a liquid storage sleeve, an air pipe arranged in the liquid storage sleeve in an axial direction of the liquid storage sleeve, and a suction nozzle arranged at an end of the liquid storage sleeve; a liquid storage chamber for storing cigarette liquid is defined by the liquid storage sleeve, and an air channel allowing airflow to flow to the suction nozzle is defined by the air pipe;

two ends of the connecting sleeve are configured to be detachably connected to the suction nozzle assembly and the battery rod, respectively;

two ends of the atomizing core are configured to be detachably connected to the connecting sleeve and the air pipe, respectively; the atomizing core and the air pipe are elastically abutted against each other or are insertedly connected, to fix the atomizing core between the suction nozzle assembly and the connecting sleeve; and the atomizing core is arranged in the liquid storage chamber and is hermetically connected to the air pipe;

the atomizing core is provided with an atomizing sleeve, a cigarette liquid locking part made of liquid-absorbing material, an atomizing seat, and an atomizing assembly;

the atomizing sleeve is provided for wrapping and protecting elements inside the atomizing core, and the atomizing sleeve is provided with a liquid guiding hole which is in communication with the liquid storage chamber;

the cigarette liquid locking part is inserted in the atomizing sleeve and covers an outer circumferential surface of the atomizing seat, and the cigarette liquid locking part fits closely with an inner circumferential surface of the atomizing sleeve, and is configured to deliver, via the liquid guiding hole on the atomizing sleeve, the cigarette liquid in the liquid storage chamber to the atomizing assembly to be atomized;

the atomizing seat is provided with an atomizing chamber, and the atomizing chamber is in communication with the air channel, and is configured to accommodate the atomizing assembly and deliver smoke, which is atomized by the atomizing assembly, to the air channel;

the atomizing assembly comprises a first atomizing device and a second atomizing device which are arranged in a radial direction of the electronic cigarette and abut against the cigarette liquid locking part;

the first atomizing device comprises at least two heat generating devices for atomizing the cigarette liquid, the heat generating devices of the first atomizing device are arranged in parallel, a liquid guiding part made of a liquid-absorbing material is provided between the heat generating devices and is arranged in parallel with the heat generating devices and abuts against the heat generating devices, two ends of the liquid guiding part both abut against the cigarette liquid locking part; and the second atomizing device comprises at least one heat generating device; and the first atomizing device and the second atomizing device are crossed with each other, and the second atomizing device is arranged between the suction nozzle and the first atomizing device, and is spaced from the first atomizing device by a certain space interval.

2. The electronic cigarette with the plurality of atomizing assemblies according to claim 1, wherein, each of the heat generating devices is provided with a heater for atomizing the cigarette liquid, and a liquid guiding wick which is configured to be winded and fixed by the heater and to deliver the cigarette liquid to the heater to be atomized.

3. The electronic cigarette with the plurality of atomizing assemblies according to claim 2, wherein, the heater is an electric heating wire; and the electric heating wire is made of nickel-chromium alloy.

4. The electronic cigarette with the plurality of atomizing assemblies according to claim 1, wherein, the liquid guiding part is a glass fiber rope.

5. The electronic cigarette with the plurality of atomizing assemblies according to claim 1, wherein, an accommodating groove with one end open and configured to fix the atomizing assembly is provided at a wall of the atomizing chamber of the atomizing seat;

the accommodating groove comprises a first accommodating groove, a second accommodating groove, a third accommodating groove, and a fourth accommodating groove;

the first accommodating groove and the second accommodating groove are arranged opposite to each other, have the same groove depth, and are jointly configured to accommodate the first atomizing device; and the third accommodating groove and the fourth accommodating groove are arranged opposite to each other, have the same groove depth, and are jointly configured to accommodate the second atomizing device; and the groove depth of each of the first accommodating groove and the second accommodating groove is greater than the groove depth of each of the third accommodating groove and the fourth accommodating groove.

6. The electronic cigarette with the plurality of atomizing assemblies according to claim 1, wherein, the air pipe is inserted into the atomizing sleeve, and is hermetically connected to the atomizing sleeve, a snap ring is provided at one end of the atomizing sleeve; and a sealing gasket is sleeved on the air pipe and hermetically abuts against the snap ring.

7. The electronic cigarette with the plurality of atomizing assemblies according to claim 1, wherein, a connection portion of the atomizing sleeve and the air pipe is provided with an accommodating groove for accommodating a sealing gasket; and an end of the air pipe hermetically abuts against the accommodating groove in which the sealing gasket is accommodated, to form a sealing connection with the atomizing sleeve.

8. The electronic cigarette with the plurality of atomizing assemblies according to claim 1, wherein, a battery assembly for powering the atomizing assembly is arranged in the battery rod;

an inner electrode and an outer electrode which are electrically connected to the atomizing assembly are further provided at an end of the atomizing core away from the air pipe;

the inner electrode and the outer electrode are configured to be electrically connected to the battery assembly, to allow the battery assembly to power the atomizing assembly;

a snap ring is provided at one end of the atomizing sleeve;

a retaining collar is provided on the outer electrode; and the snap ring and the retaining collar are configured to fix the atomizing seat between the snap ring and the retaining collar.

9. The electronic cigarette with the plurality of atomizing assemblies according to claim 8, wherein, the connecting sleeve is provided with internal threads; and the outer electrode is provided with external threads configured to cooperate with the internal threads of the connecting sleeve, and a threaded connection portion of the outer electrode and the connecting sleeve is provided with a first sealing ring, and the first sealing ring is configured to seal the threaded connection portion of the outer electrode and the connecting sleeve, to prevent the cigarette liquid in the liquid storage chamber from flowing into the battery rod.

10. The electronic cigarette with the plurality of atomizing assemblies according to claim 1, wherein, the connecting sleeve is threadedly connected to the suction nozzle assembly; and a sealing groove is provided at a threaded connection portion of the connecting sleeve and the suction nozzle assembly, and a second sealing ring is accommodated in the sealing groove, and is configured to seal the threaded connection portion of the connecting sleeve and the suction nozzle assembly, to prevent the cigarette liquid in the liquid storage chamber from flowing out of the suction nozzle assembly; and at least two sealing grooves are provided, and at least two second sealing rings are provided.

11. The electronic cigarette with the plurality of atomizing assemblies according to claim 1, wherein the cigarette liquid locking part is non-woven cloth or liquid storage cotton.

12. The electronic cigarette with the plurality of atomizing assemblies according to claim 1, wherein, the electronic cigarette further comprises a decorating part made of metal;

the decorating part is configured to be detachably connected to the connecting sleeve, and the decorating part wraps a connection portion of the connecting sleeve and the suction nozzle assembly; and a concave portion is provided on the liquid storage sleeve at a position close to the connection portion of the connecting sleeve and the suction nozzle assembly, a thickness of the liquid storage sleeve at the concave portion is smaller than a wall thickness of the liquid storage sleeve, and in the case that the decorating part wraps the connection portion of the connecting sleeve and the suction nozzle assembly, the decorating part is accommodated in the concave portion, to allow the electronic cigarette have a smooth appearance.

13. The electronic cigarette with the plurality of atomizing assemblies according to claim 1, wherein the first atomizing device is perpendicular to the second atomizing device.

14. The electronic cigarette with the plurality of atomizing assemblies according to claim 1, wherein the liquid storage sleeve is transparent.

* * * * *